US006950614B2

(12) United States Patent
Nishida

(10) Patent No.: US 6,950,614 B2
(45) Date of Patent: Sep. 27, 2005

(54) IMAGE FORMING DEVICE AND METHOD THAT CONTROLS AGITATION BASED ON DETECTED TONER AMOUNT

(75) Inventor: Akinori Nishida, Ibaraki (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/871,736

(22) Filed: Jun. 18, 2004

(65) Prior Publication Data

US 2004/0234283 A1 Nov. 25, 2004

Related U.S. Application Data

(62) Division of application No. 10/391,075, filed on Mar. 18, 2003, now Pat. No. 6,917,768.

(30) Foreign Application Priority Data

Mar. 22, 2002 (JP) ..... 2002-080273
Mar. 22, 2002 (JP) ..... 2002-080274

(51) Int. Cl.[7] ..... G03G 15/08

(52) U.S. Cl. ..... 399/27; 399/254

(58) Field of Search ..... 399/27, 61, 64, 399/254

(56) References Cited

U.S. PATENT DOCUMENTS 6,397,019 B1 * 5/2002 Kasuga ..... 399/27
6,501,933 B2 * 12/2002 Ishii ..... 399/27

FOREIGN PATENT DOCUMENTS

JP 09-190078 7/1997

* cited by examiner

*Primary Examiner*—William J. Royer
(74) *Attorney, Agent, or Firm*—Hogan & Hartson, LLP

(57) ABSTRACT

An image forming device includes a storage device that stores toner, an agitator that agitates the toner in the storage device, a detector that detects an amount of toner in the storage device, and a controller that prohibits an operation of the agitator when the detected amount of toner is equal to or more than a prescribed amount, and permits the operation of the agitator when the amount of toner is less than the prescribed amount.

15 Claims, 8 Drawing Sheets

HSYNC
PRINTER CONTROLLER
12
CHARGING BIAS IMPRESSING CIRCUIT
15
MEMORY REMOVING BRUSH VOLTAGE IMPRESSING CIRCUIT
27
TEMPER-ATURE SENSOR
32
HEATER DRIVE CIRCUIT
24
H
23
25
26
14
13
21
16
19
18
17
DEVELOPING BIAS IMPRESSING CIRCUIT
20
50
62
51
61
PAPER TRANSPOR-TATION DIRECTION
PSS
30
P

IMAGE FORMING DEVICE AND METHOD THAT CONTROLS AGITATION BASED ON DETECTED TONER AMOUNT

This is a divisional of application Ser. No. 10/391,075 filed Mar. 18, 2003 now U.S. Pat. No. 6,917,768, which application is hereby incorporated by reference in its entirety.

FIELD OF THE INVENTION

The present invention relates to an image forming device constructed to set an applied voltage for each of a developing roller, a supplying roller, and a blade according to a toner amount in a replaceable toner cartridge.

The present invention also relates to an image forming device constructed to control an agitating operation of an agitating unit within a toner cartridge according to a toner amount in a replaceable toner cartridge.

DESCRIPTION OF THE RELATED ART

There exists an image forming device that has a replaceable toner cartridge, and that develops images by using a nonmagnetic monocomponent toner. In such an image forming device, toner is stored in a cartridge, and when the toner runs out, the cartridge is replaced with a new cartridge.

An agitating unit is provided within the toner cartridge. By agitating the toner by the agitating unit, a bias of the toner within the toner cartridge can be prevented from being generated during an image forming operation.

The toner is continuously agitated within the cartridge from the time the cartridge is replaced until the next replacement. The quality of the toner differs from an early stage than at a later stage after the cartridge is replaced. This is due to a selective development phenomenon. That is, although the toner includes various microscopic sized particles, small particles are consumed at an early stage, and many large particles remain at a later stage.

Furthermore, the toner agitating operation by the agitating unit applies a load to the toner. As a result, the toner agitating unit causes the deterioration of the toner. For example, the toner particles cohere and the particle diameter increases, or additives such as silica particles are embedded in the toner particles.

That is, at the later stage after the cartridge is replaced, an image is formed by using the toner having large particles. Therefore, compared to the early stage, the deterioration of the image quality, such as a line image being broken or the darkening of a half-tone, occurs at the later stage.

SUMMARY OF THE INVENTION

According to an image forming device of the present invention, the deterioration of the toner can be controlled, and the deterioration in an image quality at a later stage after a toner cartridge has been replaced can be prevented.

The image forming device of the present invention includes a storing unit, a toner amount detecting unit, an image supporting unit, a toner supporting unit, a supply unit, a regulating unit, a voltage impressing unit, and a setting unit. The storing unit stores toner, and the toner amount detecting unit detects an amount of toner in the storing unit. The image supporting unit supports an electrostatic latent image, and the toner supporting unit supports the toner supplied to the image supporting unit. The supply unit supplies the toner stored in the storing unit to the toner supporting unit, and the regulating unit regulates a thickness of the toner layer supported by the toner supporting unit. The voltage impressing unit impresses a voltage to the toner supporting unit, the supply unit, and the regulating unit, and the setting unit sets the impressed voltage level.

When the toner amount in the storing unit is large, the setting unit sets the impressed voltage level such that a difference between each potential of the toner supporting unit, the supply unit, and the regulating unit, and a potential of the exposed image supporting unit becomes large. When the toner amount in the storing unit is small, the setting unit sets the impressed voltage level such that a difference between each potential of the toner supporting unit, the supply unit, and the regulating unit, and a potential of the exposed image supporting unit becomes small.

The image forming device further includes the following characteristics. The toner is a nonmagnetic monocomponent toner. The storing unit is replaceable. The toner amount detecting unit detects a presence or an absence of the toner at a center part of the storing unit in a vertical direction.

The image forming device further includes a detection unit which detects a replacement of the storing unit, and a cumulating unit which cumulates a number of printed pages after the storing unit is replaced. The setting unit sets the applied voltage level based on information of the detected amount of toner and information of the cumulative number of printed pages.

The toner supporting unit is a roller that supports the toner at a peripheral surface. The toner supporting unit contacts against the image supporting unit.

The supply unit is a roller which supplies the toner stored in the storing unit to the developing unit while charging the toner.

The regulating unit is a blade that contacts elastically against the toner supporting unit.

The image forming device further includes a detection unit which detects a presence or an absence of the toner at a lowest part of the storing-unit. In addition, the image forming device includes a prohibiting unit which prohibits the image forming operation when the absence of the toner at the lowest part is detected.

The image forming device further includes a notifying unit which notifies to replace the storing unit when the absence of the toner is detected at the lowest position of the storing unit.

In the image forming device of the present invention, when the amount of toner in the storing unit is small, the impressed voltage for each of the developing roller, the supplying roller, and the blade is set higher than when the toner amount is large. That is, at a later stage after the storing unit is replaced, each voltage impressed to the developing roller, the supplying roller, and the blade is shifted to a plus side than at the early stage of development. Therefore, at the later stage, the amount of toner with large particles that are transported to a photoreceptor becomes small. As a result, the breaking of the line image or the darkening of the half-tone at the later stage of development can be prevented.

It is satisfactory to change the impressed voltage according to only the amount of toner detected by the toner amount detecting unit. It is more desirable to set the impressed voltage for each of the developing roller, the supply roller, and the blade according to a cumulative number of printed pages after the toner cartridge is replaced, and the amount of toner is detected. Therefore, a highly precise applied voltage control can be carried out. As a result, deterioration in the image quality can be prevented even more effectively.

Furthermore, the image forming device of the present invention includes a storing unit, an agitating unit, a toner amount detecting unit, and a control unit. The storing unit stores toner, and the agitating unit agitates the toner in the storing unit. The toner amount detecting unit detects the amount of toner in the storing unit. The control unit prohibits an operation of the agitating unit when the detected amount of toner is equal to or more than a prescribed amount, and permits an operation of the agitating unit when the detected amount of toner is less than a prescribed amount.

The image forming device further includes the following characteristics. The storing unit is replaceable. When the operation of the agitating unit is permitted, the control unit controls the agitating unit such that the agitating operation becomes slow when the amount of toner is large, and the agitating operation becomes fast when the amount of toner is small, in accordance with the detected result of the toner amount detecting unit.

The toner amount detecting unit includes a sensor which detects a presence or an absence of the toner at an uppermost position within the agitating operation range of the agitating unit. When the sensor detects the presence of the toner, the control unit prohibits the operation of the agitating unit. When the sensor detects the absence of the toner, the control unit permits the operation of the agitating unit.

The toner amount detecting unit includes a second sensor which detects a presence or an absence of the toner at an intermediate position within the agitating operation range of the agitating unit. When the second sensor detects the presence of the toner, the control unit controls the agitating unit such that the agitating operation becomes slow. When the second sensor detects the absence of the toner, the control unit controls the agitating unit such that the agitating operation becomes fast.

The toner amount detecting unit includes a third sensor which detects a presence or an absence of the toner at a bottom of the storing unit. The control unit prohibits the operation of the agitating unit when the third sensor detects the absence of the toner.

The image forming device also includes a prohibiting unit which prohibits the image forming operation when the third sensor detects the absence of the toner.

The image forming device further includes a notifying unit which notifies to replace the storing unit. The toner is the nonmagnetic monocomponent toner.

In the image forming device of the present invention, when there is a sufficient amount of toner in the storing unit and there is no problem in the bias of the toner, the agitating unit does not agitate the toner such that to not apply a load to the toner. Therefore, compared to the conventional device wherein the agitating unit agitates the toner even when there is a sufficient amount of toner, the load applied to the toner can be reduced, and the deterioration in the toner can be prevented. Furthermore, the deterioration in the image quality can be prevented.

Moreover, when the amount of toner in the storing unit is less than a predetermined amount, it is preferable not to carry out the agitating operation by the agitating unit simply under a constant speed, but to control the speed of the agitating operation according to the amount of toner in the storing unit. That is, when the amount of toner is large, the agitating unit agitates the toner slowly. When the amount of toner is small, the agitating unit agitates the toner quickly. Accordingly, the load applied to the toner can be reduced.

DETAILED DESCRIPTION OF THE PREFERRED EMBODIMENTS

The present invention will be described in further detail by referring to a first embodiment.

Figure 1:
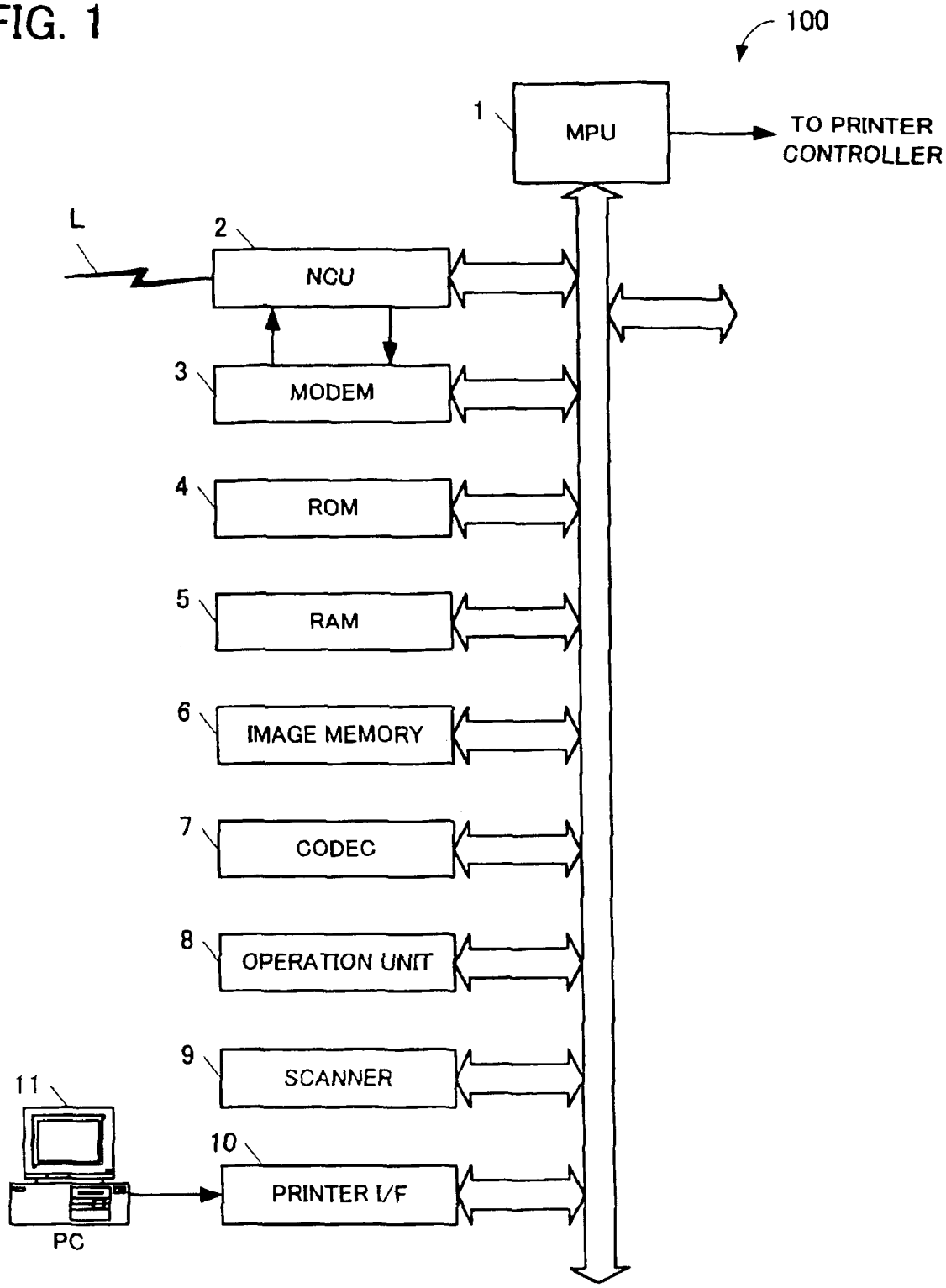
FIG. 1 is a (partial) schematic block diagram of an entire configuration of an image forming device according to a first embodiment of the present invention.
Figure 2:
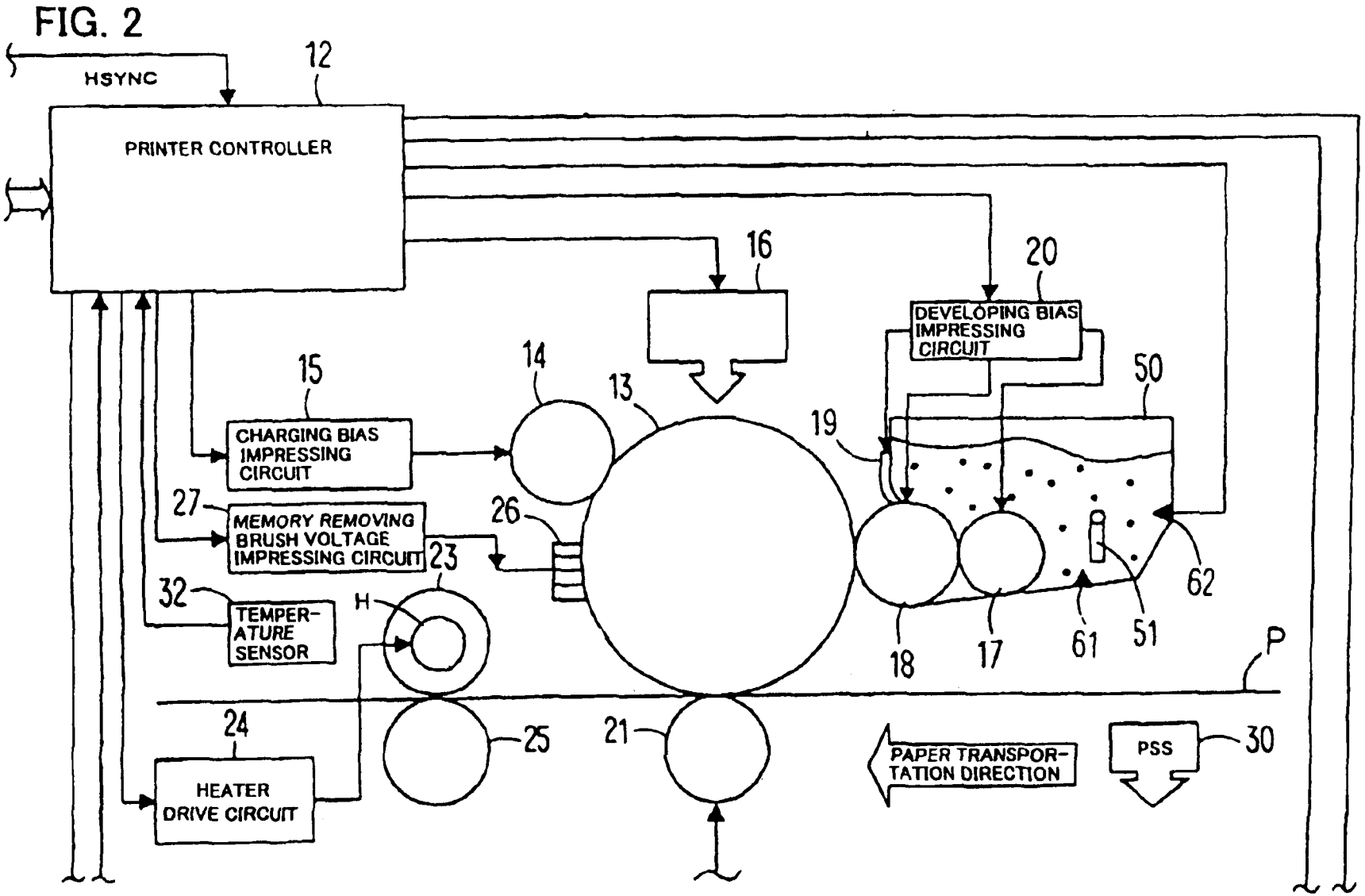
FIG. 2 is a schematic block diagram (remaining part) of an entire configuration of the image forming device.
Figure 3:
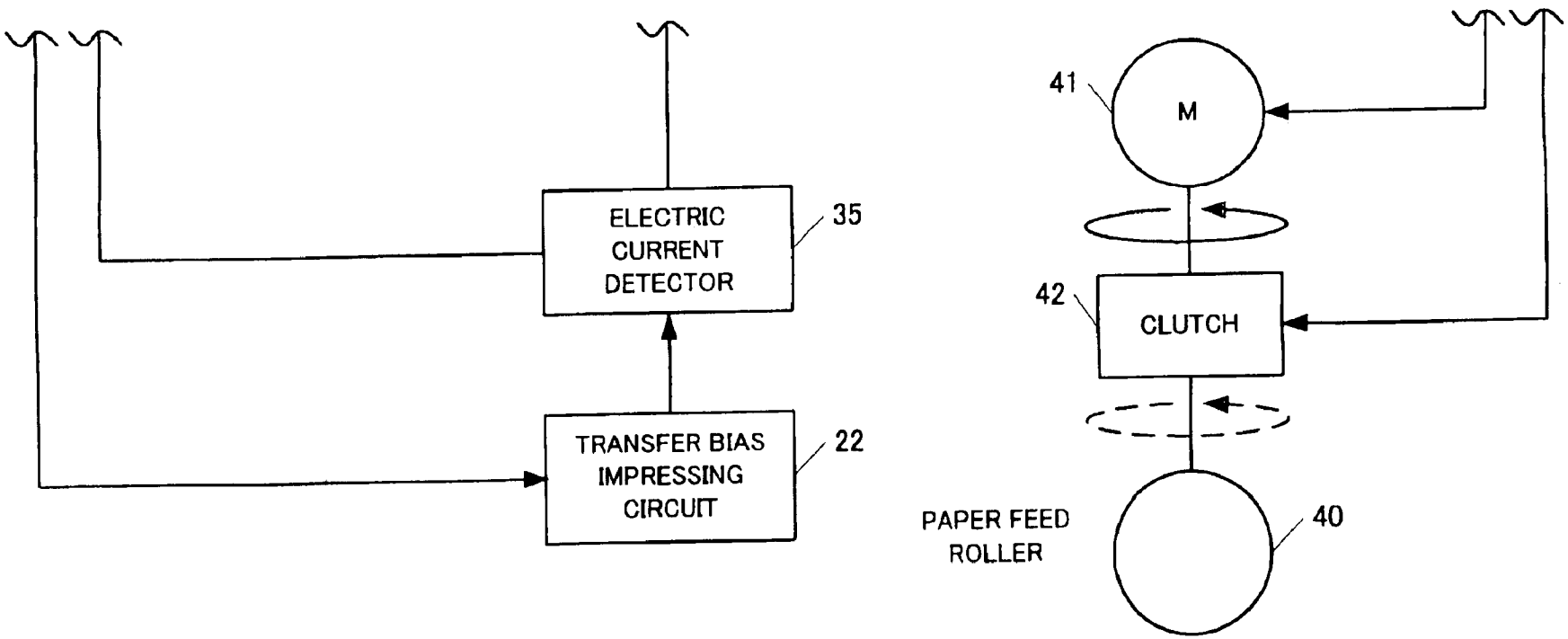
FIG. 3 is a schematic block diagram (remaining part) of an entire configuration of the image forming device.

The schematic block diagrams of an entire configuration of an image forming device 100 according to the first embodiment of the present invention are shown in FIG. 1 through FIG. 3. The image forming device 100 is constructed as a multi-function peripheral that includes a facsimile function and a copy function. The image forming device 100 includes a Micro Processing Unit (MPU) 1, a Network Control Unit (NCU) 2, a modem 3, a Read Only Memory (ROM) 4, a Random Access Memory (RAM) 5, an image memory such as a Dynamic Random Access Memory (DRAM) 6, a Coder and Decoder (CODEC) 7, an operation unit 8, a scanner 9, and a printer interface (I/F) 10. A personal computer 11 is connected to the printer I/F 10.

The MPU 1 controls each of the units that forms the image forming device 100. The NCU 2 is controlled by the MPU 1, and connects and disconnects a line L and the image forming device 100. The NCU 2 transmits a dial pulse according to a telephone number of a destination, and detects an incoming call. Here, the line L is connected to a Public Switched Telephone Network (PSTN).

The modem 3 modulates transmitting data and demodulates receiving data in accordance with V.17, V.27ter, V.29 or the like based on a facsimile transmission control protocol following the International Telecommunications Union (ITU-T) Recommendation T.30. Alternatively, the modem 3 modulates the transmitting data and demodulates the receiving data in accordance with V.34 in addition to the above-mentioned protocols.

The ROM 4 stores programs for controlling the image forming device 100. The RAM 5 temporarily stores data or-the like. The image memory 6 temporarily stores received image data or image data scanned by the scanner 9. The CODEC 7 encodes the image data scanned to be transmitted, and decodes the received image data by Modified Huffman (MH), Modified Read (MR), Modified Modified Read (MMR) methods or the like. The operation unit 8 is for a user to indicate FAX transmission/reception, printing or the like. The scanner 9 scans image data of an original when carrying out a FAX transmission.

The printer in the image forming device 100 includes a printer controller (control unit) 12 for controlling each part of the printer. The printer controller 12 sets an applied voltage. When the toner amount in a toner cartridge 50 detected by a toner amount detecting unit 62 is large, the printer controller 12 sets an applied voltage to be low (more to a minus side) to each of a supplying roller (supply unit) 17, a developing roller (toner supporting body) 18, and a blade (regulating unit) 19. When the detected toner amount is small, the printer controller 12 sets the impressed voltage for each of the parts to be higher (more to a plus side) than when the toner amount is large.

A photosensitive drum 13 is provided within the printer. The photosensitive drum 13, as an electrostatic latent image supporting body, includes a photoconductive layer around the peripheral surface. The photosensitive drum 13 is rotated by a main motor 41. A charging brush 14, as a brush roller charger, is provided around the photosensitive drum 13. A prescribed bias voltage is applied to the charging brush 14 by a charging bias impressing circuit 15. The charging brush 14 impressed with the bias voltage charges the peripheral surface of the photosensitive drum 13 uniformly while rotating.

A Light Emitting Diode (LED) print head 16, as an exposing unit, is provided around the photosensitive drum 13. The LED print head 16 is formed with a plurality of LED being arranged in a line. The LED print head 16 exposes light on the peripheral surface of the photosensitive drum 13 in accordance with input image information. Therefore, the LED print head 16 forms an electrostatic latent image corresponding to the image information on the peripheral surface.

Furthermore, a developer is provided around the photosensitive drum 13. The developer includes the supplying roller 17, the developing roller 18, the blade 19, and a developing bias impressing circuit 20. A prescribed bias voltage is applied to the supplying roller 17 by the developing bias impressing circuit 20. The supplying roller 17 charges the toner stored in the toner cartridge 50, and supplies the charged toner on the developing roller 18. The developing roller 18 is provided so as to contact against the supplying roller 17 and the photosensitive drum 13. A prescribed bias voltage is applied to the developing roller 18 by the developing bias impressing circuit 20.

The blade 19 contacts elastically against the peripheral surface of the developing roller 18. The blade 19 regulates a thickness of the toner layer adhering to the peripheral surface of the developing roller 18 to be even. A prescribed bias voltage is also applied to the blade 19 by the developing bias impressing circuit 20.

Furthermore, a transfer roller 21 is provided around the photosensitive drum 13, and is rotated by the main motor 41. The transfer roller 21 is provided to contact against the peripheral surface of the photosensitive drum 13 in order to sandwich a paper transportation path P. A prescribed bias voltage is applied to the transfer roller 21 by a transfer bias impressing circuit 22. An electric current of the transfer roller 21 is detected by an electric current detector 35. Then, the printer controller 12 maintains the detected electric current value. The printer controller 12 determines a transfer voltage corresponding to the detected electric current value during the transfer process period, and the transfer bias impressing circuit 22 impresses the determined transfer voltage to the transfer roller 21.

A fuser is provided at the paper discharging location of the paper transportation path P. The fuser includes a heat roller 23, a heater drive circuit 24, and a press roller 25 or the like. Further, the heat roller 23 includes a heater H such as a halogen lamp. A temperature sensor 32 detects a surface temperature of the heat roller 23. The heater H driver circuit 24 controls the heater of the heat roller 23 such that the peripheral surface of the heat roller 23 holds a prescribed temperature. The heat roller 23 and the press roller 25 fuse the toner image on a paper by heating and pressing the paper after being transferred by the transfer roller 21.

In the image forming device 100, a memory removing brush 26 is provided around the photosensitive drum 13. The memory removing brush 26 removes the toner image (memory image) remaining along an outline of the image on the peripheral surface of the photosensitive drum 13 even after the transfer. A prescribed bias voltage is applied to the memory removing brush 26 by a memory removing brush voltage impressing circuit 27.

Furthermore, in the image forming device 100, a Paper Supply Sensor (PSS) 30 is provided upstream of the photosensitive drum 13 and the transfer roller 21 along the paper transportation path P. The PSS 30 is a sensor which detects whether or not paper is transported from a paper supply cassette (not shown in the drawings). The PSS 30 is switched ON when paper is transported from the paper supply cassette.

At the paper supplying side, a feed roller 40 and the main motor 41 are connected via a clutch 42. When taking out paper from the paper supply cassette, the feed roller 40 is connected to the main motor 41 by the clutch 42, and by the feed roller 40 being rotated, paper is taken out from the paper supply cassette one sheet at a time.

The toner cartridge 50 stores the toner, and can be replaced within the image forming device 100. The toner is nonmagnetic, monocomponent and negative electrostatic. The toner stored in the toner cartridge 50 is agitated by an agitator 51 provided inside the toner cartridge 50. A toner absence detecting unit (for example, a photoelectric sensor) 61 is provided at the bottom of the toner cartridge 50. The toner absence detecting unit 61 detects the presence and the absence of the toner in the toner cartridge 50.

Moreover, the toner amount detecting unit (for example, a photoelectric sensor) 62 is provided at the side of the toner cartridge 50. The toner amount detecting unit 62 detects whether or not there is toner located at a level where the toner amount detecting unit 62 is provided. This height level becomes a standard for changing each applied voltage of the supplying roller 17, the developing roller 18, and the blade 19. In FIG. 2, the position of the toner amount detecting unit 62 is located approximately at the intermediate position in the vertical direction of the side of the toner cartridge 50. However, this position can be changed accordingly.

Next, a printing operation will be described. The charging brush 14 charges the photosensitive drum 13 uniformly. The LED print head 16 forms an electrostatic latent image corresponding to image information on the photosensitive drum 13. The toner is adhered to the electrostatic latent image on the photosensitive drum 13 by the developing roller 18. Then, a toner image is formed on the photosensitive drum 13. Next, the toner image on the photosensitive drum 13 is transferred to paper by the transfer roller 21. After the toner image is transferred, the heat roller 23 and the press roller 25 heat and pressurize the paper, and the toner image is fused on the paper.

In the image forming device 100 of the first embodiment, when the toner in the toner cartridge 50 is being detected by the toner amount detecting unit 62, that is, when the amount of toner is large, the printer controller 12 sets the applied voltage for each of the supplying roller 17, the developing roller 18, and the blade 19 to be low (more to the minus side). When the toner is not detected, that is, when the amount of toner is small, the printer controller 12 sets the applied voltage for each of the parts to be higher (more to the plus side) than when the amount of toner is large.

Figure 4:
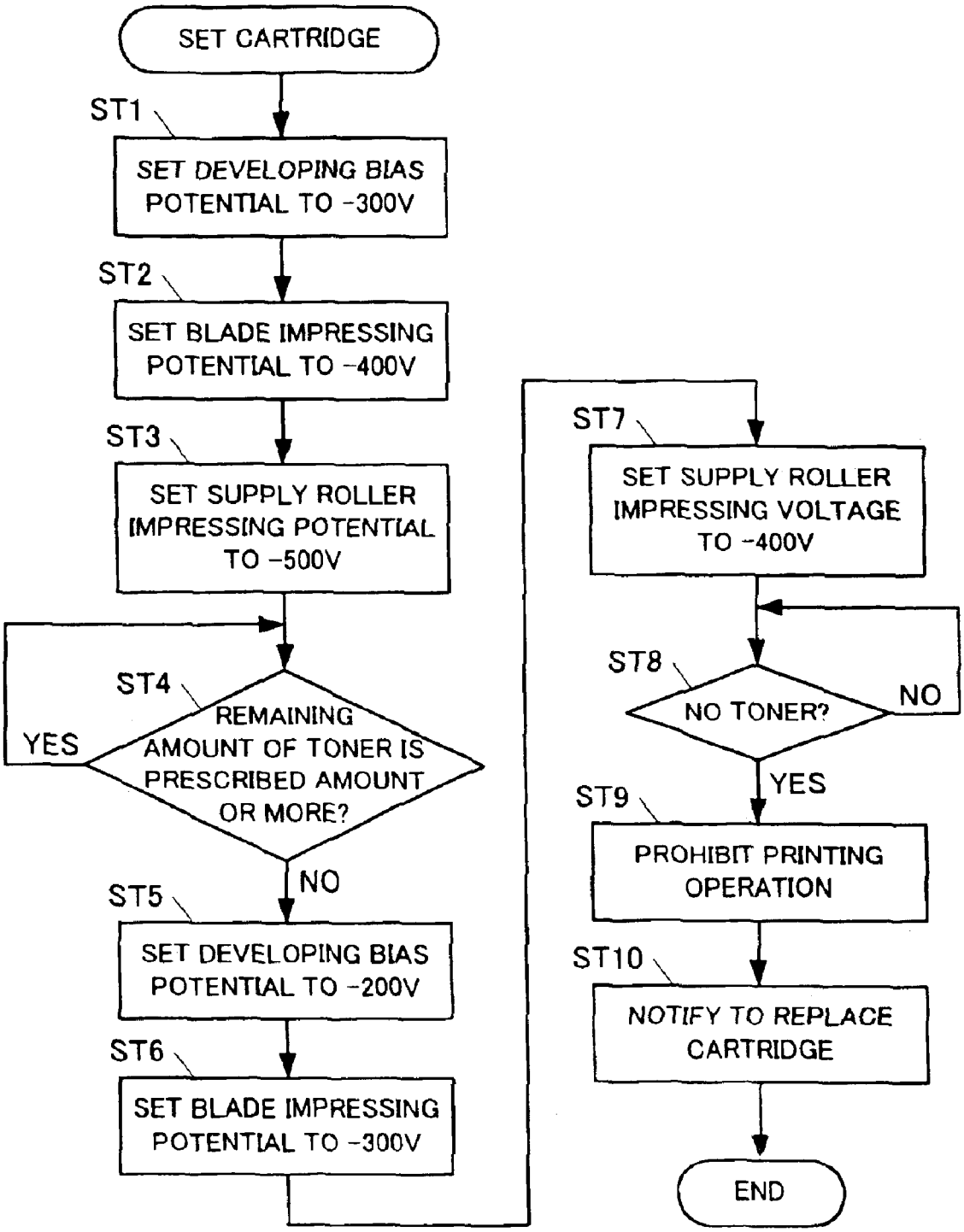
FIG. 4 is a flowchart showing the control for impressing voltage according to the toner amount in the toner cartridge.

This operation will be described with reference to the flowchart shown in FIG. 4.

A new toner cartridge 50 is inserted in the image forming device 100. In step ST1, since the toner amount detecting unit 62 is ON at an early stage after being inserted, in other words, since the amount of toner in the toner cartridge 50 is large, the developing bias impressing circuit 20 sets the applied voltage (developing bias potential) of the developing roller 18 to −300V. In step ST2, the applied voltage of the blade 19 is set to 400V. In step ST3, the applied voltage of the supplying roller 17 is set to −500V. The image forming operation is continued by the set applied voltage.

Eventually in step ST4, it is determined whether or not the toner amount detecting unit 62 is ON, in other words, whether or not the amount of toner is equal to or more than a prescribed amount. When it is determined YES in step ST4, the image forming operation continues with the set applied voltage. When the toner amount detecting unit 62 is switched OFF and the amount of toner becomes less than a prescribed amount, in step ST5, the applied voltage (developing bias potential) of the developing roller 18 is set to −200V. Moreover, in step ST6, the applied voltage of the blade 19 is set to −300V. In step ST7, the applied voltage of the supplying roller 17 is set to −400V.

Next in step ST8 it is determined whether or not the toner absence detecting unit 61 is switched OFF. In other words, it is determined whether or not the toner in the toner cartridge 50 has run out. When there is toner still remaining in the toner cartridge 50, the printing operation is continued by the above applied voltage set in steps ST5 through ST7. However, when the toner runs out, in step, ST9, the printing operation is prohibited. Furthermore, in step ST10, notification is made to replace the toner cartridge 50 by pronouncing, displaying, or the like.

According to the above-described operation, when the amount of toner in the toner cartridge 50 becomes less than a prescribed amount, the applied voltage for each of the supplying roller 17, the developing roller 18, and the blade 19 is set more to the plus side than when the amount of toner is large. Therefore, even at the later stage after the toner cartridge 50 is replaced, the amount of large particles transported to the photosensitive drum 13 becomes small. As a result, the breaking of the line image or the darkening of the half-tone that are prone to occur when the remaining amount of toner is small can be prevented.

Further, in the above embodiment, the applied voltage for each of the supplying roller 17, the developing roller 18, and the blade 19 is set in two stages. However, the present invention is not limited to this example, and for example, a plurality of toner amount detecting units can be provided, and the applied voltage can be set in three stages or more, or can be set and changed consecutively. It is satisfactory to change the applied voltage according to only the toner amount detected by the toner amount detecting unit. It is more desirable to set the applied voltage for each of the developing roller 18 the supply roller, 17, and the blade 19 according to a cumulative number of printed pages after the toner cartridge 50 is replaced, and the toner amount is detected. Therefore, a highly precise applied voltage control can be carried out. As a result, deterioration in the image quality can be prevented even more effectively.

Next, an image forming device 101 according to a second embodiment of the present invention will be described.

Figure 5:
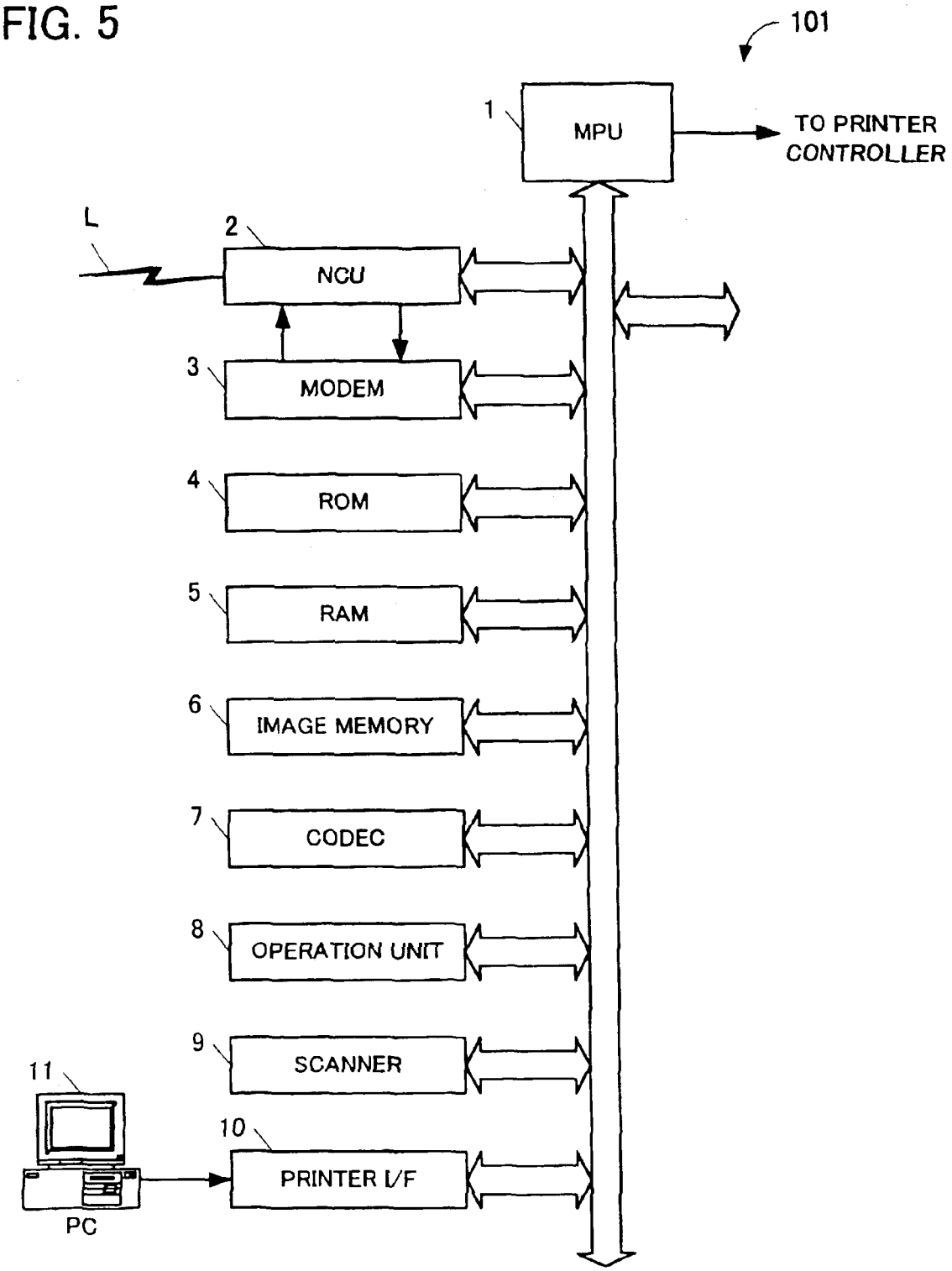
FIG. 5 is a (partial) schematic block diagram of an entire configuration of an image forming device according to a second embodiment of the present invention.
Figure 6:
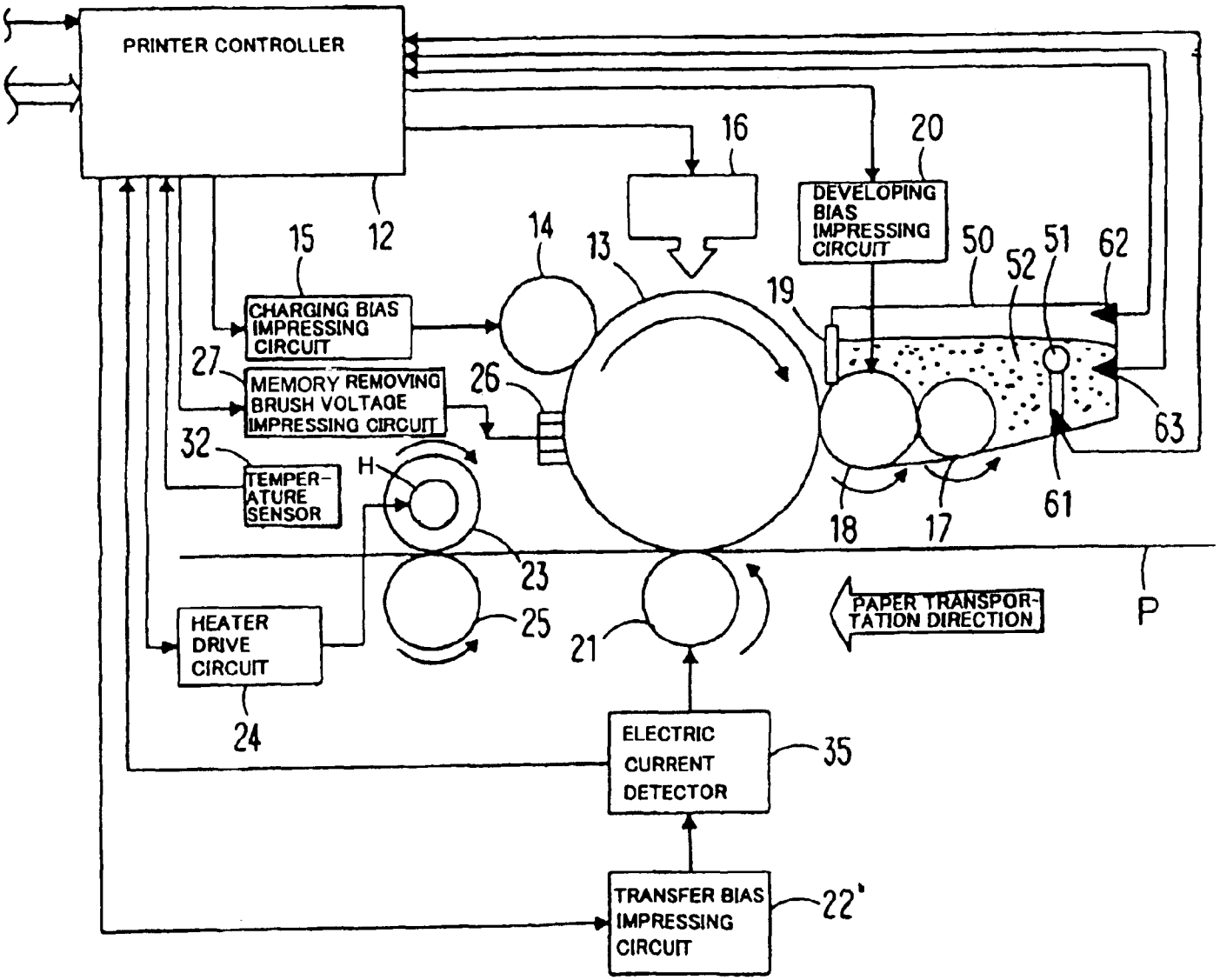
FIG. 6 is a schematic block diagram (remaining part) of an entire configuration of the image forming device.
Figure 7:
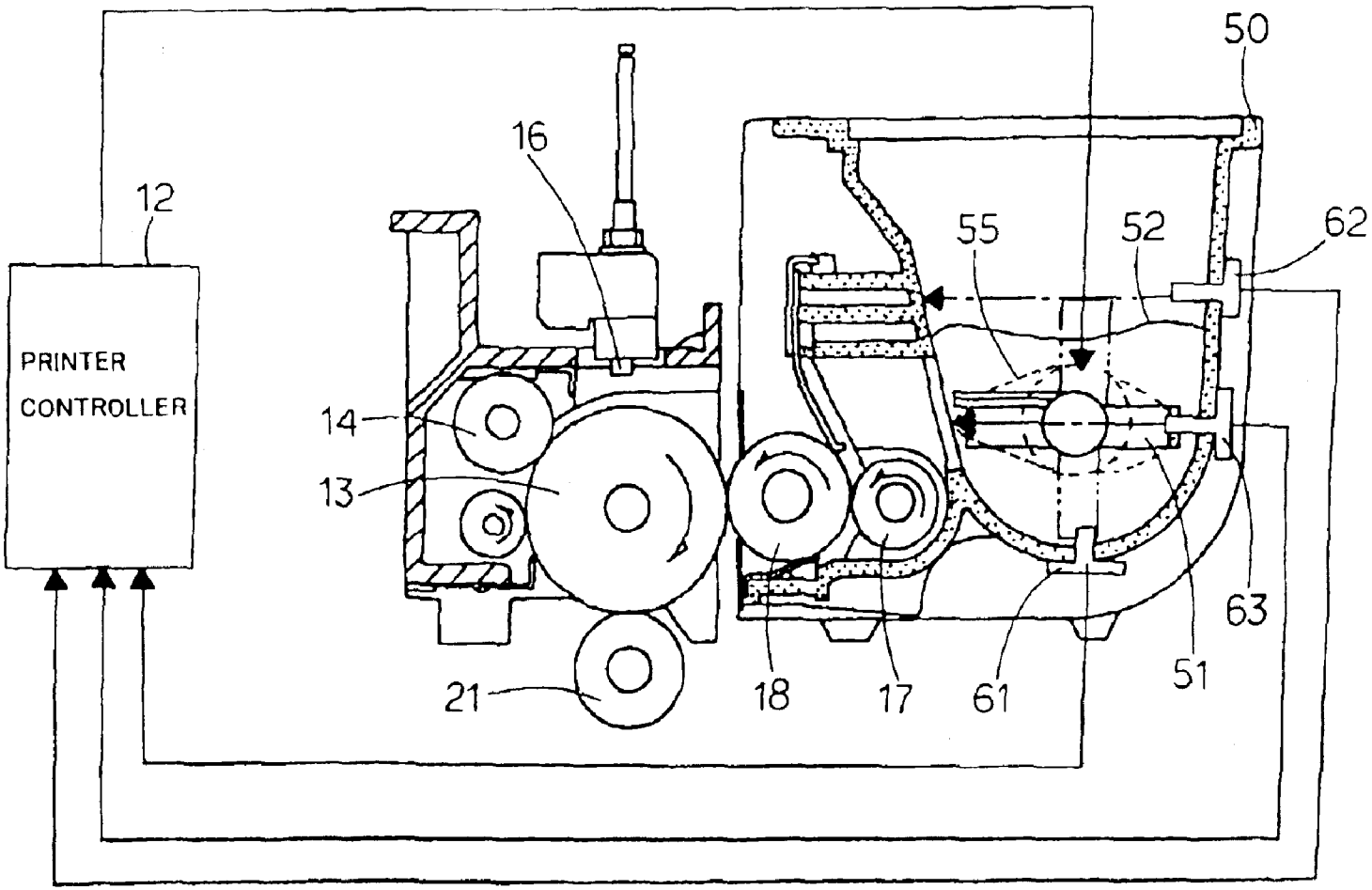
FIG. 7 is an enlarged cross-sectional view-of the toner cartridge and parts around the toner cartridge in the image forming device.

The schematic block diagrams of the entire configuration of the image forming device 101 are shown in FIG. 5 through FIG. 7. Since the basic configuration of the image forming device 101 of the second embodiment is the same as the image forming device 100 of the first embodiment, the description for the part of the image forming device 101 common to the image forming device 100 will be abbreviated.

A printer in the image forming device 101 includes a printer controller (control unit) 12 that controls each part of the printer. When a first toner detecting sensor 62 detects the amount of toner in the toner cartridge 50 to be equal to or more than a predetermined amount, the printer controller 12 prohibits the operation of the agitator (agitating unit) 51. When the first toner detecting sensor 62 detects the amount of toner to be less than a predetermined amount, the printer controller 12 permits the operation of the agitator 51. Moreover, in the case the amount of toner in the toner cartridge 50 is less than a predetermined amount, the printer controller 12 agitates the toner slowly by the agitator 51 when the amount of toner is large, and agitates the toner quickly by the agitator 51 when the amount of toner is small, in accordance with the detected result of a second toner detecting sensor 63.

FIG. 7 shows an enlarged cross-sectional view of the toner cartridge 50. The toner cartridge 50 stores a toner 52, and is replaceable in the image forming device 101. The toner 52 is nonmagnetic, monocomponent, and negative electrostatic. An agitator (agitating unit) 51 for agitating the toner 52 in the toner cartridge 50 is provided inside the toner cartridge 50. A motor 55 rotates and drives the agitator 51. The printer controller (control unit) 12 controls the motor 55. A toner absence sensor 61, which is a third sensor, is provided at the bottom of the toner cartridge 50. The toner absence sensor 61 detects the presence or the absence of the toner 52 in the toner cartridge 50.

Moreover, the first toner detecting sensor 62 is located at the toner cartridge 50, at an uppermost position within the agitating operation range of the agitator 51 in the vertical direction. The first toner detecting sensor 62 detects the presence or the absence of the toner 52 at the position where the first toner detecting sensor 62 is provided. This position becomes the standard for prohibiting or permitting the agitating operation of the agitator 51. Furthermore, the second toner detecting sensor 63 is provided at an intermediate position within the agitating operation range of the agitator 51 in the vertical direction (at a position located at a height approximately the same as the rotating shaft of the agitator 51). The second toner detecting sensor 63 detects whether or not there is toner 52 remaining up to a position where the second toner detecting sensor 63 is provided. This becomes the standard for switching the speed of the agitating operation of the agitator 51 to be slow or fast.

Figure 8:
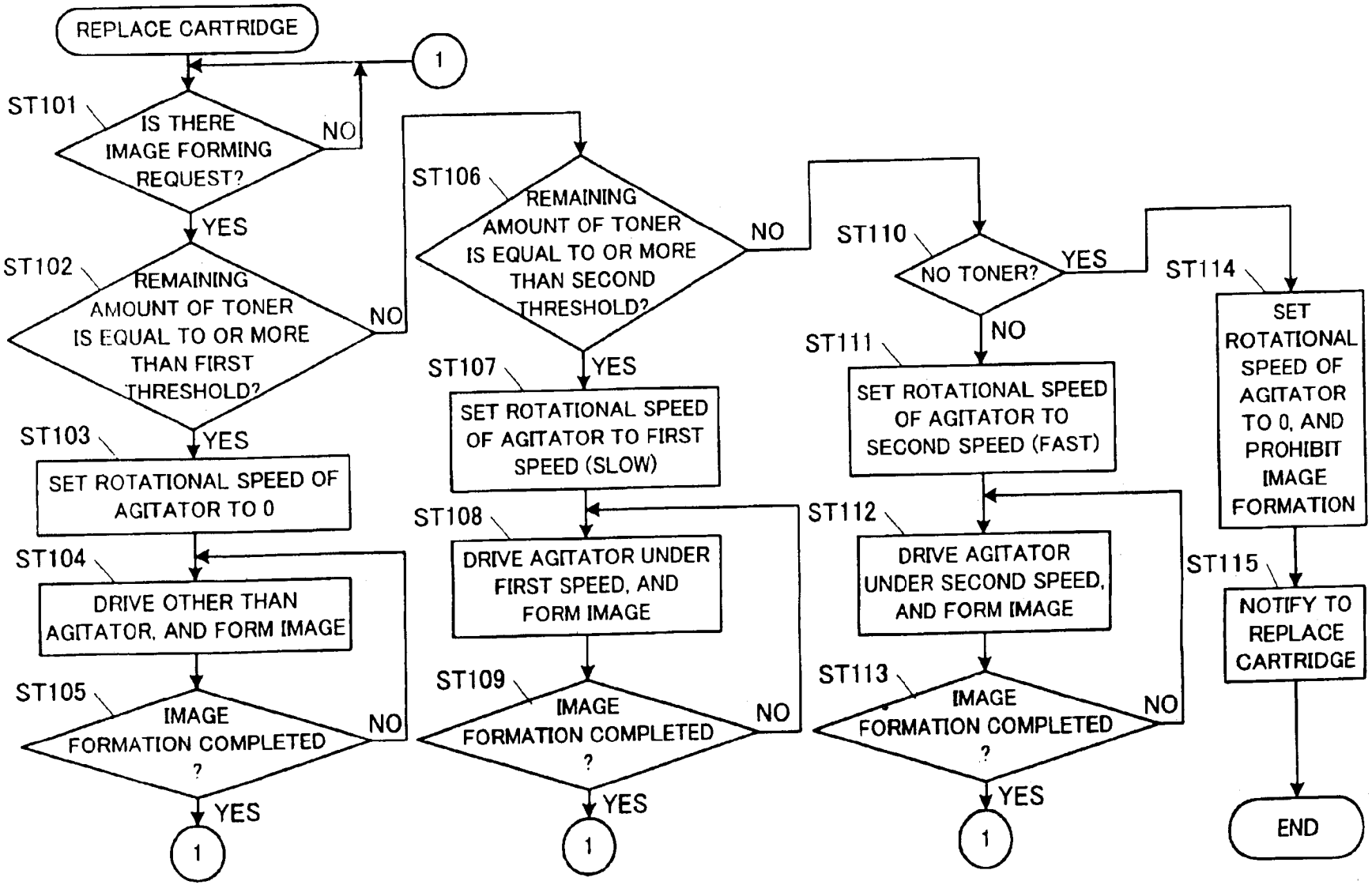
FIG. 8 is a flowchart showing the control for the agitating operation of the agitator according to the toner amount in the toner cartridge.

The agitating operation of the agitator 51 according to the amount of toner 52 in the toner cartridge 50 in the image forming device 101 will be described with reference to the flowchart shown in FIG. 8.

A new toner cartridge 50 is set in the image forming device 101. In step ST101, it is determined whether or not there is an image forming request. The image forming device 101 is on standby until it is determined that there is an image forming request. When there is the image forming request, in step ST102, it is determined whether or not the amount of toner 52 in the toner cartridge 50 is equal to or more than a first threshold. That is, it is determined whether or not the first toner detecting sensor 62 is detecting the toner 52.

When the toner 52 is detected by the first toner detecting sensor 62, there is sufficient amount of toner 52 in the toner cartridge 50, and it is not necessary to agitate the toner 52 by the agitator 51. Therefore, in step ST103, a rotational speed of the agitator 51 is set to 0 (prohibiting the agitating operation of the agitator 51). In step ST104, each of the parts that are necessary for the image formation other than the agitator 51 are driven, and the image formation is carried out. Then, in step ST105, it is determined whether or not the image formation has been completed. When it is determined NO in step ST105, the process returns to step ST104. The image formation is continued without operating the agitator 51. When the image formation is completed, the process returns to the step ST101. Then, it is determined whether or not there is an image forming request, and the image forming device 101 stands by until there is an image forming request.

Meanwhile, in step ST102, when the first toner detecting sensor 62 does not detect the toner 52, the amount of toner 52 in the cartridge 50 is less than the first threshold. Therefore, the process proceeds to step ST106. In step ST106, it is determined whether or not the amount of toner 52 in the toner cartridge 50 is equal to or more than a second threshold. That is, it is determined whether or not the toner 52 is detected by the second toner detecting sensor 63.

When the toner 52 is detected by the second toner detecting sensor 63, the amount of toner 52 in the toner cartridge 50 is not sufficient but slightly low. Therefore, to prevent the bias of the toner 52 in step ST107, the rotational speed of the agitator 51 is set to a first speed (slow). That is, it is set for the agitating operation of the agitator 51 to be slow. In step ST108, the agitator 51 is driven under the first speed, and the image formation is carried out.

Then, in step ST109, it is determined whether or not the image formation has been completed. When it is determined NO in step ST109, the process returns to step ST108. The image formation is continued with the agitator 51 being driven under the first speed. When the image formation is completed, the process returns to step ST101.

Meanwhile, when the toner 52 is not detected by the second toner detecting sensor 63 in step ST106, the amount of toner 52 has become less than the second threshold. Therefore, the process proceeds to step ST110. In step ST110, it is determined-whether or not the toner 52 in the toner cartridge 50 has run out. That is, it is determined whether or not the toner 52 is detected by the toner absence sensor 61.

When the toner 52 is detected by the toner absence sensor 61, the amount of toner 52 in the toner cartridge 50 has become considerably low. Therefore, to prevent the bias of the toner 52 reliably, in step ST111, the rotational speed of the agitator 51 is set to a second speed (fast). That is, it is set such that the agitating operation of the agitator 51 becomes fast. In step ST112, the agitator 51 is driven under the second speed, and the image formation is carried out. Then, in step ST113, it is determined whether or not the image formation has been completed. When it is determined NO in step ST113, the process returns to step ST112, and the image formation is continued while driving the agitator 51 under the second speed. When the image formation is completed, the process returns to step ST101.

Meanwhile, when the toner 52 is not detected by the toner absence sensor 61 in step ST110, the toner 52 in the toner cartridge 50 has run out. Therefore, to prohibit a printing operation, the process proceeds to step ST114. In step ST114, the rotational speed of the agitator 51 is set to 0 (prohibit the agitating operation of the agitator 51). Then, in step ST115, it is notified to replace the toner cartridge 50 by pronouncing, displaying or the like.

According to this operation, when there is sufficient amount of toner 52 in the toner cartridge 50 and there is no problem with the bias of the toner 52, the agitating operation of the agitator 51 is prohibited. Therefore, a load is not applied to the toner 52. Thus, compared to the conventional device wherein the toner 52 is always agitated the load applied to the toner 52 can be reduced, and the deterioration in the toner 52 can be prevented. As a result, the deterioration in the image quality can be prevented.

Furthermore, even in the case the amount of toner 52 in the toner cartridge 50 becomes small and the toner 52 is agitated by the agitator 51, when there is a medium amount of toner 52, the agitator 51 is rotated slowly, and after the amount of toner 52 has become considerably low, the agitator 51 is rotated quickly. Therefore, compared to the conventional device in which the agitator 51 is simply rotated under a constant speed, the load applied to the toner 52 can be reduced even more.

Further, according to the second embodiment, the agitating operation by the agitator 51 is adjusted by two speeds, fast and slow. However, the present invention is not limited to this example. For example, the number of toner detecting sensors can be increased, and the agitating operation can be adjusted in three speeds or more, or can be adjusted consecutively.

What is claimed is:

1. An image forming device comprising:

means for storing toner;

means for agitating the toner in the means for storing;

means for detecting an amount of toner in the means for storing; and means for prohibiting an operation of the means for agitating when the detected amount of toner is equal to or more than a prescribed amount, and for permitting an operation of the means for agitating when the detected amount of toner is less than the prescribed amount, wherein when the operation of the means for agitating is permitted, the means for prohibiting controls the means for agitating such that the agitating operation becomes slow when the toner amount is large, and the agitating operation becomes fast when the toner amount is small in accordance with the detected result of the means for detecting.

2. The image forming device according to claim 1, wherein the means for storing is replaceable.

3. The image forming device according to claim 1, wherein the toner is a nonmagnetic monocomponent toner.

4. An image forming device comprising:

means for storing toner;

means for agitating the toner in the means for storing;

means for detecting an amount of toner in the means for storing; and means for prohibiting an operation of the means for agitating when the detected amount of toner is equal to or more than a prescribed amount, and for permitting an operation of the means for agitating when the detected amount of toner is less than the prescribed amount, wherein the means for detecting includes a sensor which detects a presence or an absence of the toner at an uppermost position within an agitating operation range of the means for agitating, and the means for prohibiting prohibits the operation of the means for agitating when the sensor detects the presence of the toner, and permits the operation of the means for agitating when the sensor detects the absence of the toner, and wherein the means for detecting further includes a second sensor which detects a presence or an absence of the toner at an intermediate position within the agitating operation range of the means for agitating, and the means for prohibiting controls the means for agitating such that the agitation operation becomes slow when the second sensor detects the presence of the toner, and agitating operation becomes fast when the second sensor detects the absence of the toner.

5. The image forming device according to claim 4 wherein the means for detecting, includes a third sensor which detects a presence or an absence of the toner at a bottom of the means for storing, and the means for prohibiting prohibits the operation of the means for agitating when the third sensor detects the absence of the toner.

6. The image forming device according to claim 5, further comprising means for prohibiting the an image forming operation when the third sensor detects the absence of the toner.

7. The image forming device according to claim 5, further comprising a means for notifying to replace the means for storing.

8. An image forming method comprising:

detecting a toner amount in a cartridge;

permitting an agitating operation by an agitator within the cartridge when the detected toner amount is less than a prescribed amount; and when the agitating operation is permitted, slowing the agitating operation when the toner amount is large, and speeding up the agitating operation when the toner amount is small.

9. The image forming method according to claim 8, further comprising replacing the cartridge.

10. The image forming method according to claim 9, further comprising notifying to replace the cartridge.

11. The image forming method according to claim 8, further comprising providing the toner as a nonmagnetic monocomponent toner.

12. An image forming method comprising:

detecting a toner amount in a cartridge;

permitting an agitating operation by an agitator within the cartridge when the detected toner amount is less than a prescribed amount;

detecting a presence or an absence of the toner at an uppermost position within an agitating operation range of the agitator; and permitting an operation of the agitator when detecting the absence of the toner.

13. An image forming method comprising:

detecting a toner amount in a cartridge;

permitting an agitating operation by an agitator within the cartridge when the detected toner amount is less than a prescribed amount;

detecting a presence or an absence of the toner at an intermediate position within an agitating operation range of the agitator; and slowing the agitating operation of the agitator when the presence of the toner is detected at the intermediate position, and speeding the agitating operation of the agitator when the absence of the toner is detected at the intermediate position.

14. An image forming method comprising:

detecting a toner amount in a cartridge;

permitting an agitating operation by an agitator within the cartridge when the detected toner amount is less than a prescribed amount;

detecting a presence or an absence of the toner at a bottom of the cartridge;

and prohibiting an operation of the agitator when the absence of the toner is detected at the bottom.

15. The image forming method according to claim 14, further comprising prohibiting an image forming operation when the absence of the toner is detected at the bottom of the cartridge.

* * * * *